United States Patent [19]

Obermayer

[11] 4,422,417

[45] Dec. 27, 1983

[54] PULLBACK STARTER FOR INTERNAL COMBUSTION ENGINES

[75] Inventor: Alfred Obermayer, Lambach, Austria

[73] Assignee: Bombardier-Rotax Gesellschaft m.b.H., Gunskirchen, Austria

[21] Appl. No.: 345,235

[22] Filed: Feb. 3, 1982

[30] Foreign Application Priority Data

Feb. 27, 1981 [AT] Austria ..... 910/81

[51] Int. Cl.[3] ..... F02N 3/02

[52] U.S. Cl. ..... 123/185 BA; 123/185 B

[58] Field of Search ..... 123/185 B, 185 BA, 185 BB, 123/185 A, 185 R; 74/6

[56] References Cited

U.S. PATENT DOCUMENTS 4,149,510 4/1979 Koga et al. ..... 123/185 BA 4,291,654 9/1981 Obermayer ..... 123/185 B

*Primary Examiner*—Andrew M. Dolinar

*Attorney, Agent, or Firm*—Kurt Kelman

[57] ABSTRACT

A pullback starter comprises a rope pulley rotatably mounted on an axle and on which a driving coupling element is mounted for pivotal movements to constitute an engageable and disengageable coupling of a clutch for the drive shaft of an internal combustion engine. A coil spring surrounds the axle and is braked against rotation thereon by friction. The spring has first and second legs protruding from the axle at opposite ends of the spring. A locking member engaged by the first leg is rotatably mounted in the coupling element for rotation relative thereto between locking and unlocking positions. A first stop is carried by the coupling element, second and third stops are carried by the locking member, the second stop being arranged so that, when the locking member is in its unlocking position, the second stop engages the first stop, and the third stop being arranged so that, when the locking member is in its locking position, it prevents pivotal movement of the coupling element, a further stop is carried by the coupling element and is adapted to engage the second leg so as to define the locking position, and a safety stop is carried by the first leg and engages the second leg to act on the latter in a sense tending to untwist the spring.

2 Claims, 4 Drawing Figures

Figure 1:
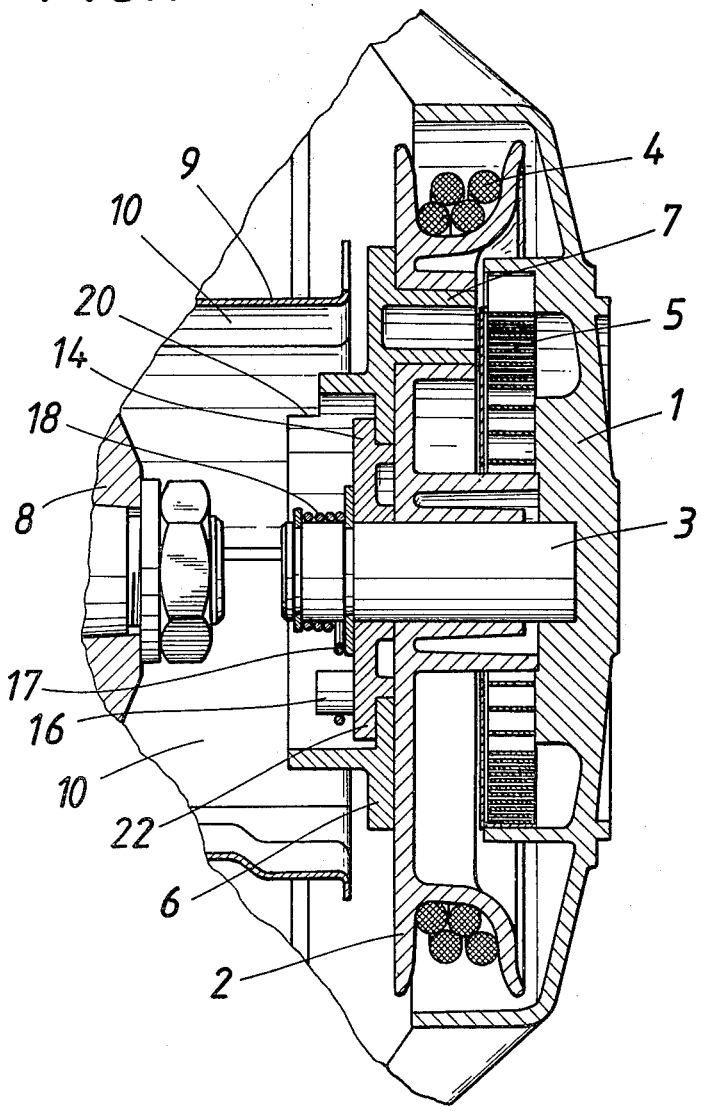

FIG. 3
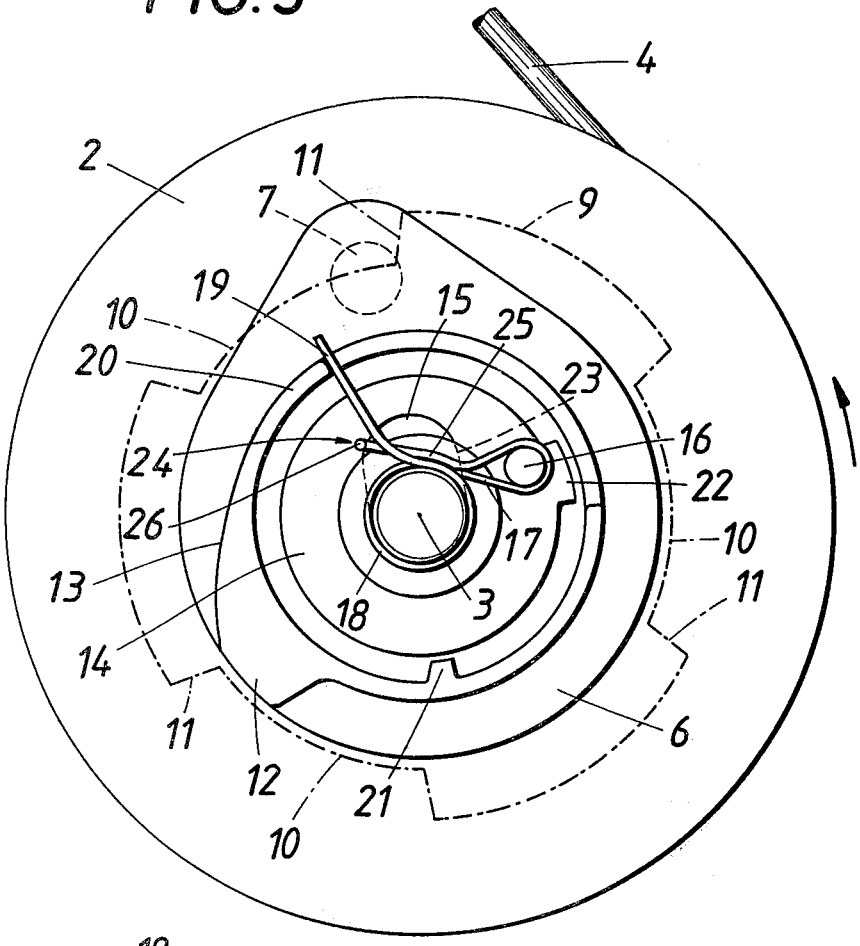
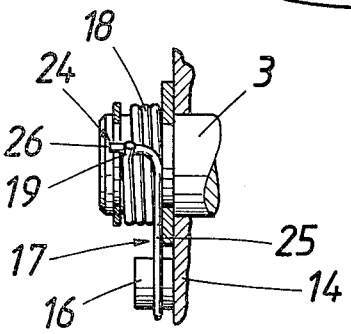
FIG. 4

PULLBACK STARTER FOR INTERNAL COMBUSTION ENGINES

This invention relates to a pullback starter for internal combustion engines, comprising a housing, a rope pulley, which is rotatably mounted in the housing on a fixed axle and by means of an unwindable rope is adapted to be driven against the force of a pullback spring, and a driving coupling element, which is mounted on said pulley for a pivotal movement an axis which is parallel to the axis of said axle, which driving coupling element constitutes the engageable and disengageable coupling element of a clutch for connecting the pulley to a drive shaft of the internal combustion engine, a frictionally braked, resilient clutch control member, which is rotatably mounted on said fixed axle and adapted to impart to said driving coupling element a pivotal movement in inward and outward directions, said clutch control member comprising a coil spring, which surrounds said axle and tends to embrace the same under initial stress and has a first end leg protruding from said axle and engaging a locking member, which is mounted in said driving coupling element for rotation relative thereto between locking and unlocking positions and carries a stop. A first stop is carried by the driving coupling element, a second stop is carried by the locking member and is so arranged that, when the latter is in its unlocking position, the second stop engages the first stop, and a third stop is carried by the locking member and is so arranged that, when the latter is in its locking position, it prevents pivotal movement of the driving coupling element, said driven coupling element carrying another stop, which is engageable with said second leg in a sense tending to untwist said spring and to define said locking position.

As in pullback starter of that kind the clutch control member does not act directly on the driving coupling element but on a locking member which is rotatably mounted in the driving coupling element, the clutch control member which is frictionally braked on the axle holds the locking member against a rotation about said axle when the rope pulley begins to rotate. This results in a rotation of the locking member relative to the driving coupling element, which is driven by the rope pulley. That relative rotation of the locking member is utilized to lock and unlock the driving coupling element because the locking member carries a stop, which in the locking position is disposed before and engages said axle so that the driving coupling element cannot be pivotally moved outwardly on its pivotal axis. For unlocking the locking member, the latter must be rotated; this is accomplished by the clutch control member during the actuation of the pullback starter. After a rotation of the locking member relative to the driving coupling element to an extent which is sufficient for unlocking, the clutch is engaged in that the locking member engages a stop carried by the driving coupling element so that there is a positive coupling between the locking member and the driving coupling element for the continued movement. By the clutch control member engaging the locking member, the driving coupling element is moved pivotally outwardly to the position in which the clutch is engaged. Because a further outward pivotal movement of the driving coupling element is prevented, the clutch control member is rotated about the fixed axle as the rotation of the rope pulley is continued. This is possible because the coil spring, which constitutes the clutch control member, has a leg which engages the locking member and acts on said spring in an untwisting sense.

These movements are performed in a reverse sequence during a reverse rotation of the rope pulley, When the coil spring has been relieved from the torque of the rope pulley, the coil spring holds the locking member in position so that the locking member is rotated in the opposite sense relative to the driving coupling element and rotates the latter to its initial, inner position. But the movement imparted by the stop of the locking member to the coil spring does not begin until the locking member has performed a rotation relative to the driving coupling element so that the stop of the locking member is disposed before and engages the fixed axle in the sense of the outward pivotal movement of the driving coupling element before the locking member is non-rotatably connected to the driving coupling element. The locking position of the locking member must not be defined by a stop which acts on the locking member itself because in that case the locking member would exert on the associated spring leg a tensile force which would prevent a rotation of the spring on the fixed axle. Such a self-locking action should be prevented and conditions which are favorable such as those encountered during the starting operation should be provided. For this purpose, the driving coupling element carries a stop, which cooperates with the second leg of the spring and acts on said second leg in a sense tending to untwist said spring.

The engagement of that stop with the second end leg of the coil spring defines the locking position of the locking member spring because the latter is held in position relative to the fixed axle only until the second leg of the spring engages the associated stop carried by the driving coupling element. The use of a clutch control member consisting of a coil spring prevents an undesired rotation of the locking member in response to forces acting thereon and prevents a rotation of the clutch control member in response to vibration because any vibratory forces will be effective only in the first convolutions rather than in the middle portion of the spring.

But in spite of these advantages, said pullback starter may be damaged when a backfiring of the engine during a starting operation causes the drive shaft of the internal combustion engine to impart a reverse rotation to the driving coupling element, which is then in its clutch-engaging position. Such a reverse rotation will then be imparted to the locking member, which is connected by the coil spring to the fixed axle. During such a rotation of the locking member, the coil spring is acted upon in a twisting sense and is thus caused to non-rotatably embrace the fixed axle. On the other hand, the coil spring holds the locking member against such rotation so that the pullback starter will inevitably be damaged. In such case the connection between the locking member and the associated spring leg will usually be eliminated in that the spring end portion consisting of a connecting hook is bent open so that the pullback starter is rendered inoperative.

It is an object of the invention to avoid these disadvantages and so to improve a pullback starter of the kind described first hereinbefore that there is no risk of damage to the starter also during a backfiring of the internal combustion engine during a starting operation.

This object is accomplished according to the invention in that that leg of the spring which engages the locking member constitutes a safety stop, which acts on the second leg of the spring in a sense tending to untwist the spring.

When a backfiring of the engine during a starting operation results in a reverse rotation of the driving coupling element and of the locking member, the two legs of the spring will initially perform a slight movement relative to each other owing to the elasticity of that leg of the spring which engages the locking member. By means of the safety stop which is constituted by the spring leg which engages the locking member, that relative movement is utilized to load the second leg of the spring, i.e. that leg of the spring which does not engage the locking member, in a sense tending to untwist the coil spring. As a result, the coil spring can no longer be stressed in a twisting sense and is rotated about the fixed axle in unison with the locking member so that damage to the spring or to other components of the starter will be reliably avoided.

A particularly simple structure will be obtained within the scope of the invention if the safety stop consists of a hook-shaped end portion of the spring leg which engages the locking member. When that spring leg is loaded by the locking member rotating in a reverse sense so that the spring leg extending in U-shape around a pin of the locking member is loaded in a sense tending to bend open the U-shaped leg, that additional movement of the hook-shaped end portion of the spring leg can also be utilized to act on the second leg of the spring in a sense tending to untwist the spring because that additional movement changes the point where the safety stop engages the free leg of the spring.

Figure 2:
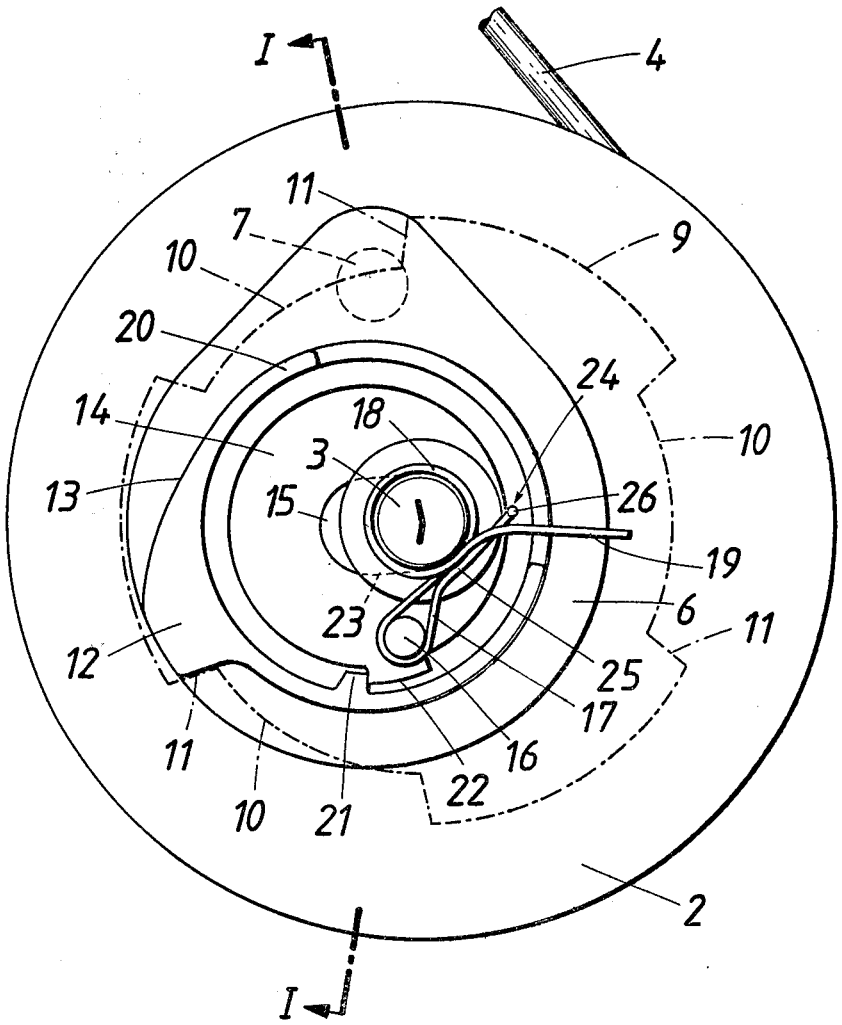

An embodiment of the invention is shown by way of example on the accompanying drawings, in which FIG. 1 is an axial sectional view taken on line I—I in FIG. 2 and shows a pullback starter according to the invention, FIG. 2 is a top plan view showing the pullback starter when the driving coupling element has been swung out, FIG. 3 is a view which is similar to FIG. 2 and shows the pullback starter with the driving coupling element turned in, and FIG. 4 is a side elevation showing a clutch control member consisting of a coil spring.

As is apparent particularly from FIG. 1, the pullback starter comprises a housing 1, which is adapted to be flanged to an internal combustion engine and in which a rope pulley 2 is rotatably mounted on an axle 3, which is non-rotatably connected to the housing 1. A rope 4 is wound on the rope pulley 2 and can be pulled from the rope pulley 2 in order to drive the latter against the force of a pullback spring 5.

A driving coupling element 6 is eccentrically mounted on the rope pulley 2 by means of a pivot pin 7, which is mounted in a bearing eye of the rope pulley. The coupling element 6 constitutes the engageable and disengageable coupling element of a clutch, which comprises a pot-shaped second coupling element 9. The latter is connected to the drive shaft 8 of the internal combustion engine. As is indicated in phantom in FIGS. 2 and 3, the pot-shaped coupling element 9 has reentrant wall portions 10, which have side faces 11 cooperating with a protruding nose 12 of the coupling element 6. When the coupling element 6 is swung out from its initial position, shown in FIG. 3, to its engaged position, shown in FIG. 2, the nose 12 of the coupling element 6 engages one of the side faces 11 to transmit a rotation of the rope pulley 2 via the pot-shaped coupling element 9 to the drive shaft 8. To disengage the clutch, the coupling element 6 must be turned in in the opposite sense. When the drive shaft 8 overruns the rope pulley 2, the protruding wall portions 10 of the pot-shaped coupling element 9 engage a run-up surface formed by the bridge 13 of the nose 12 and thus turn in the coupling element 6.

A disk-shaped locking member 14 is rotatably mounted in the coupling element 6, which surrounds the fixed axle 3. The locking member 14 has a slot 15, through which the fixed axle 3 extends. The locking member 14 carries an axially protruding pin 16, which extends into a U-shaped end leg 17 of a coil spring 18, which embraces the fixed axle 3 under initial stress. The also protruding second end leg 19 of that spring cooperates with a stop 20 provided on the coupling element 6. By means of its second leg 19 the coil spring thus limits the rotation of the locking member 14 relative to the coupling element 6 in one direction. The rotation of the locking member 14 in the opposite sense is limited by the cooperation of a first stop 21 carried by the coupling element 6 and a second stop 22 carried by the locking member 14.

When the locking member 14 is in the stop-defined position shown in FIG. 2, the slot 15 of the locking member 14 is concentric to the pivotal axis of the coupling element 6, which pivotal axis is defined by the pivot pin 7. In that position the coupling element 6 can be pivotally moved about the pin 7 to an extent which is determined by the length of the slot 15. When the locking member 14 has been rotated to the position shown in FIG. 3, the longitudinal axis of the slot 15 is approximately radial with respect to the pivot pin 7 so that a pivotal movement of the coupling element 6 is prevented. It is apparent that the coupling element 6 can be locked and unlocked by the locking member 14.

The locking member 14 is rotated by the coil spring 18, which non-rotatably connects the locking member 14 to the axle 3 between the two stop-defined positions shown in FIGS. 2 and 3. For this reason, a rotation of the rope pulley 2 will cause the locking member 14 to rotate relative to the coupling element 6 until the stop 21 of the coupling element 6 engages the stop 22 of the locking member 14. Because the locking member 14 can no longer rotate relative to the coupling element 6 when the stop 21 of the coupling element 6 has engaged the stop 22 of the locking element 14, the coil spring 18 now also holds the coupling element 6 against rotation on the axle by means of the pin 16 so that the coupling element 6 is swung out as the pin 7 follows the rotation of the rope pulley 2. The outward pivotal movement of the coupling element 6 is limited by the engagement of the fixed axle 3 with the other end of the slot 15 (FIG. 2), whereafter the pin 6, which is held in position by the spring 18, also follows the rotation of the rope pulley 2 and transmits that rotation to the coil spring 18. This rotation of the coil spring 18 with the rope pulley 2 is facilitated by the fact that the leg 17 of the spring is loaded in a spring-untwisting sense.

The operations described above are performed in a reverse sequence as the rope pulley 2 is turned back by the pullback spring 5. The pin 16 held in position by the spring 18 first causes the coupling element 6 to be turned in so that the nose 12 disengages the side faces 11 of the pot-shaped coupling element 9. The continued rotation of the rope pulley 2 causes the locking member 14 to disengage the stop 21 of the coupling element 6 because the coupling element 6 is now free to follow the rotation of the rope pulley 2. The locking member 14 is held in position by the spring 18 until the further stop 20 of the coupling element 6 has engaged the second leg 19 of the spring and acts on the spring in an untwisting sense. As a result, the rotation of the coupling element 6 about the fixed axle 3 is transmitted to the spring 18, which carries the locking member 14 along. The longitudinal edge 23 of the slot 15 constitutes a third stop and in that phase extends approximately radially with respect to the pivot pin 7. For unlocking the locking member 14, the latter must be rotated relative to the coupling element 6; this can be effected only by an operation of the pullback starter.

During a backfiring of the internal combustion engine when the starter is in the position shown in FIG. 2, the coupling element 6 and the locking member 14 are rotated in a reverse sense. Such a reverse rotation is restricted by the spring 18, which is stressed in a twisting sense by a reverse rotation. To ensure that the U-shaped spring leg 17 extending around the pin 16 will not be bent open by such reverse rotation, the spring leg 17, which engages the locking member 14, constitutes a safety stop 24. For this purpose the U-shaped end portion 25 of the spring leg 17 is laterally bent to form a hook 26, which extends behind the second spring leg 19. When the locking member 14 is rotated in such a sense that the pin 16 rotates the coil spring 18 in a twisting sense, so that the spring embraces the axle 3 more firmly, the spring leg 17 will perform an elastic pivotal movement relative to the second spring leg 19 so that the hook 24 will engage the second spring leg 19 and will load the latter in a sense tending to untwist the coil spring 18. As a result, the clamping action is restricted and the coil spring 18 can rotate together with the locking member 14 relative to the fixed axle 3 without a risk of damage.

What is claimed is:

1. In a pullback starter for an internal combustion engine having a drive shaft carrying a driven coupling element, which starter comprises a housing, an axle disposed in, and fixed to, said housing, a rope pulley rotatably mounted on said axle, a rope wound on said pulley and adapted to be pulled from said pulley to rotate the same on said axle in a predetermined sense, a pullback spring opposing a rotation of said pulley in said predetermined sense, a driving coupling element mounted on said pulley for inward and outward pivotal movements on an axis which is parallel to and spaced from the axis of said axle, said driving coupling element being adapted to constitute an engageable and disengageable coupling element of a clutch comprising said driven coupling element, a coil spring surrounding said axle and tending to embrace the same in frictional contact therewith so as to be braked against rotation on said axle, which spring is provided at opposite ends with first and second legs protruding from said axle, a locking member rotatably mounted in said driving coupling element for rotation relative thereto between locking and unlocking positions, and engaged by said first leg, a first stop carried by said driving coupling element, a second stop carried by said locking member and so arranged that, when the latter is in its unlocking position, said second stop engages the first stop carried by said driving coupling element, a third stop carried by said locking member and so arranged that, when the latter is in its locking position, it prevents pivotal movement of said driving coupling element, and a further stop carried by said driving coupling element and adapted to engage said second leg in a sense tending to untwist said spring and to define said locking position, the improvement of a safety stop carried by said first leg and adapted to engage said second leg and to act on the latter in a sense tending to untwist said spring.

2. The improvement set forth in claim 1, wherein said first leg has a hook-shaped end portion which constitutes said safety stop.

* * * * *